US005370756A

United States Patent [19]

Buis et al.

[11] Patent Number: 5,370,756

[45] Date of Patent: Dec. 6, 1994

[54] SUBSTRATE SPLICES FOR ROOFING

[75] Inventors: Charles D. Buis; Paul R. Weedlun, both of Greenville, S.C.

[73] Assignee: Milliken Research Corporation, Spartanburg, S.C.

[21] Appl. No.: 70,127

[22] Filed: Jun. 1, 1993

[51] Int. Cl.[5] ..... E04D 5/00

[52] U.S. Cl. ..... 156/71; 156/157; 156/309.6; 156/311; 156/312; 156/324; 156/4; 428/58; 428/61

[58] Field of Search ..... 156/71, 157, 159, 276, 156/308.2, 309.6, 309.9, 311, 312, 324.4, 505; 428/57, 58, 61

[56] References Cited

U.S. PATENT DOCUMENTS

| | | | |
|---|---|---|---|
| Re. 31,808 | 1/1985 | London, Jr. et al. | 57/6 |
| 2,495,761 | 1/1950 | Platt | 156/157 |
| 2,726,222 | 12/1955 | Palmquist et al. | 260/25 |
| 3,134,703 | 5/1964 | Listner | 156/157 |
| 3,649,411 | 3/1972 | Bolles | 156/391 |
| 3,921,265 | 11/1975 | Eschenbach | 28/1 CL |
| 3,947,619 | 3/1976 | Wank | 428/57 |
| 4,372,998 | 2/1983 | Shimada | 156/324.4 X |
| 4,410,575 | 10/1983 | Obayashi et al. | 156/157 X |
| 4,530,868 | 7/1985 | Shinmi et al. | 428/61 X |
| 4,551,375 | 11/1985 | Sato et al. | 428/57 |
| 4,722,857 | 2/1988 | Tomioka et al. | 156/308.2 X |
| 4,829,761 | 5/1989 | Phillips et al. | 57/248 |
| 4,855,172 | 8/1989 | Chiu | 428/57 |
| 4,923,348 | 5/1990 | Carlozzo et al. | 411/377 |
| 4,959,952 | 10/1990 | Kato et al. | 57/261 |
| 5,056,200 | 10/1991 | Schwartz et al. | 28/285 |
| 5,077,126 | 12/1991 | Green | 428/374 |
| 5,091,047 | 2/1992 | Cleeves et al. | 156/643 |
| 5,094,567 | 3/1992 | Nista et al. | 405/227 |
| 5,148,509 | 9/1992 | Kannabiran | 385/109 |
| 5,151,320 | 9/1992 | Homonoff et al. | 428/284 |

FOREIGN PATENT DOCUMENTS

| | | | |
|---|---|---|---|
| 720083 | 10/1965 | Canada | 156/157 |
| 1376302 | 9/1964 | France | 156/308.2 |
| 2423216 | 12/1974 | Germany . | |
| 95555 | 7/1980 | Japan . | |

*Primary Examiner*—Mark A. Osele

*Attorney, Agent, or Firm*—Kevin M. Kercher; Terry T. Moyer

[57] ABSTRACT

An improved substrate splice for roofing and the associated method for the creation of an improved substrate splice. This can be achieved by taking a fiberglass scrim that has at least one layer of nonwoven fabric positioned adjacent thereto. Splicing involves overlapping this material and heating to a temperature of between 450° and 1,000° F. while applying 1 to 1,000 pounds per square inch. The preferred range of temperature is between 500° to 700° F. with 1 to 4 p.s.i. of pressure. Two layers of fiberglass backed thermoplastic tape is applied to each side of this splice. The tape is then heated to between 450° and 1000° F. while also applying pressure of 0 to 1,000 pounds per square inch. The preferred range of temperature is between 500° to 700° F. with 1 to 4 p.s.i. of pressure.

32 Claims, 2 Drawing Sheets

*FIG. —1—*

SUBSTRATE SPLICES FOR ROOFING

BACKGROUND OF THE INVENTION

This invention relates to creation of a roofing splice and associated process. The splices are typically made in roofing substrates with thermoplastic tape. One major problem is that the tape adhesive softens as the splice passes through an asphalt coater. This is typically around 400° F. The tape adhesive will fail if the coater tension and speed is not reduced. Therefore, one of the major problems in the industry is the creation of a substrate splice capable of passing through an asphalt coater at production speeds and tensions without failing.

The present invention solves this problem and other in the manner not disclosed in the known prior art.

SUMMARY OF THE INVENTION

An improved substrate splice for roofing and the associated method for the creation of an improved substrate splice. This can be achieved by taking a fiberglass scrim that has at least one layer of nonwoven fabric positioned adjacent thereto. Splicing involves overlapping this material and heating to a temperature of between 450° and 1,000° F. while applying 0 to 1,000 pounds per square inch. The preferred range of temperature and pressure is between 500° to 700° F. and between 1 to 4 p.s.i. Two layers of fiberglass backed thermoplastic tape is applied to each side of this splice. The tape is then heated to between 450° and 1000° F. while also applying pressure of 0 to 1,000 pounds per square inch. The preferred range of temperature and pressure is between 500° to 700° F. and between 1 to 4 p.s.i.

The advantage of this invention is that the splice described above can be processed on a typical bitumen coater at up to 450° F. at standard speeds and tensions without failing.

Yet another advantage of this invention is that the physical properties of the spliced area will be equal to or exceed those of the unspliced areas of the same substrate.

Still another advantage of this invention is that the productivity of the coater will be improved.

Another advantage of this invention is that the splice can be processed at standard conditions.

A further advantage of this invention is that it reduces waste. Products made under nonstandard conditions such as low speed and tension are not first quality.

Another advantage of this invention is smaller sections of roofing substrate can be utilized at lower cost with higher quality.

These and other advantages will be in part apparent and in part pointed out below.

BRIEF DESCRIPTION OF THE DRAWINGS

The above as well as other objects of the invention will become more apparent from the following detailed description of the preferred embodiments of the invention when taken together with the accompanying drawings, in which.

Corresponding reference characters indicate corresponding parts throughout several views of the drawings.

DETAILED DESCRIPTION OF THE PREFERRED EMBODIMENT

Figure 1:
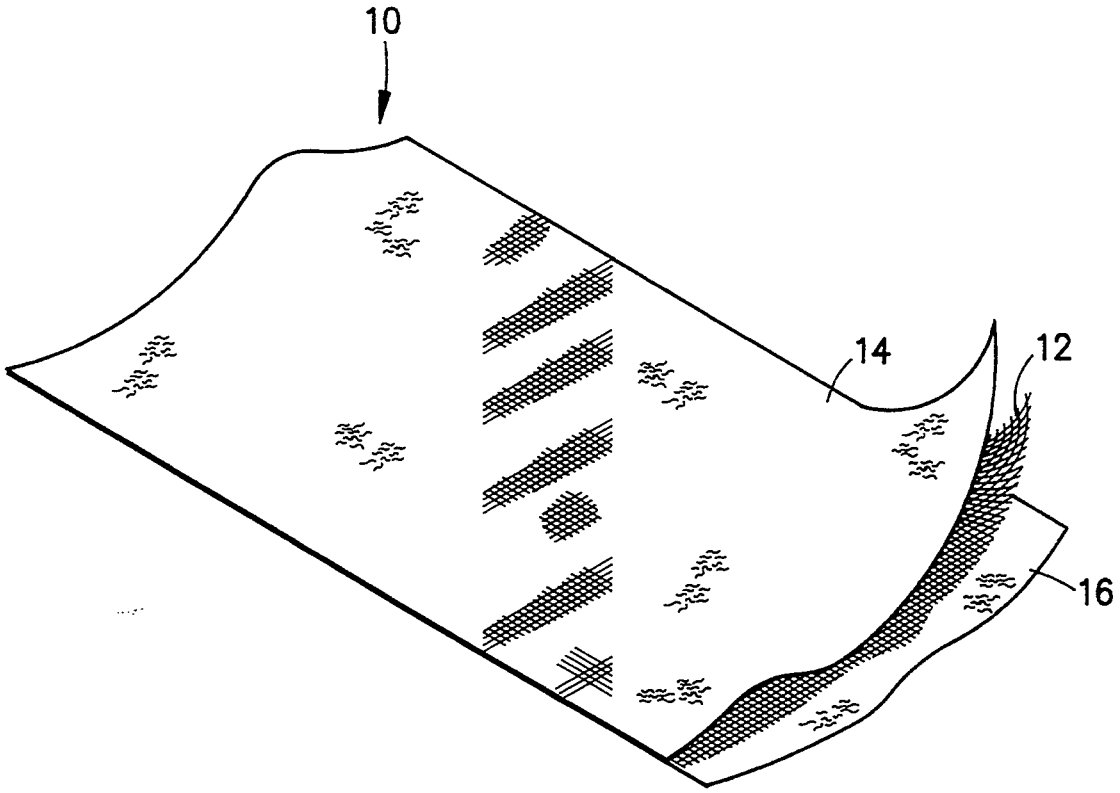
FIG. 1 is a perspective view of two layers of nonwoven fabric surrounding a layer of fiberglass scrim having heat and pressure applied thereto, and incorporating novel features of the present invention.

Referring now by reference numerals to the drawings, and first to FIG. 1, the roofing substrate is generally indicated by numeral 10. The central component of the roofing substrate 10 is a fiberglass scrim 12. The preferred embodiment of fiberglass scrim 12 is a 6×6, G-37×G-37 fiberglass yarn that has been dip coated with a polyvinyl alcohol binder. The construction of the scrim as well as the yarn size and yarn type as well as the type of binder may be significantly altered as long as the scrim does not provide 100% coverage. Fiberglass yarn may be purchased from Owens-Corning-Fiberglas Company, Fiberglas Tower, Toledo, Ohio 43659. One Hundred (100%) percent coverage is defined as eliminating all openings in the scrim between adjacent yarns. The yarn in the scrim must be heat resistant which is defined as not melting below 500° F.

U.S. Pat. No. 3,649,411 issued on Mar. 14, 1972 discloses a typical means for creating a scrim. The disclosure hereof is incorporated herein by reference as if fully stated herein. Another published patent which discloses a means for creating a scrim includes U.S. Pat. No. 3,921,256 issued on Nov. 25, 1975. The disclosure hereof is incorporated herein by reference for full description and clear understanding of the improved features of the present invention as if fully stated herein.

The roofing substrate 10 should also include at least one layer of nonwoven fabric. As shown in FIG. 1, the preferred roofing substrate 10 has both an upper nonwoven fabric layer 14 and a lower nonwoven fabric layer 16. The preferred nonwoven fabric would be a 0.55 oz./yd$^2$ Reemay ®-type 2250 polyester. However, any nonwoven fabric that can be remelted at about 450° F. or at least below 500° F. and can act as an adhesive can be used. The nonwoven fabric may be in the form of one or more layers on either one side or on both sides. Once again, this nonwoven fabric will melt and flow within the holes in the fiberglas scrim 12. Therefore, this is evidence of why the fiberglass scrim 12 cannot provide 100% coverage. This nonwoven fabric is a spun-bond composite fabric. One means for creating a fabric of this type is disclosed in U.S. Pat. No. 5,151,320 which issued on Sep. 29, 1992. Disclosure thereof is incorporated herein by reference for full description and understanding the improved features of the present invention and is considered a part of this application as if fully stated herein. U.S. Pat. No. 4,923,348 issued May 8, 1990 is another example of a polyester nonwoven fabric that is also utilized in a roofing-type application. Furthermore, this disclosure is also incorporated herein by reference as if fully set forth herein.

The polyester fibers used in either the upper nonwoven fabric layer 14 or lower nonwoven fabric layer 16 can be obtained from Reemay (a member of the Inter-Tech Group, Inc.), Industrial Road, P.O. Box 511, Old Hickory, Tenn. 37138.

Figure 2:
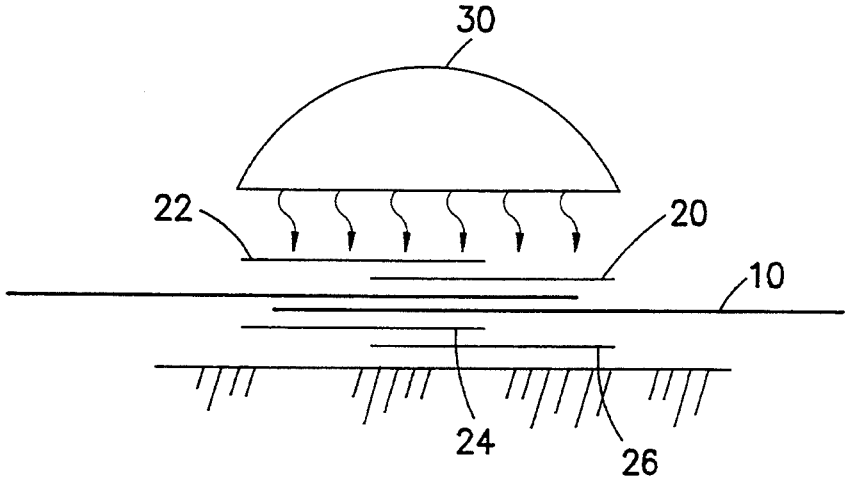
FIG. 2 is a schematic elevational view of a means for applying heat and pressure over two layers of thermoplastic tape on top of a splice of nonwoven fabric and fiberglass scrim and another two layers of thermoplastic tape.
Figure 3:
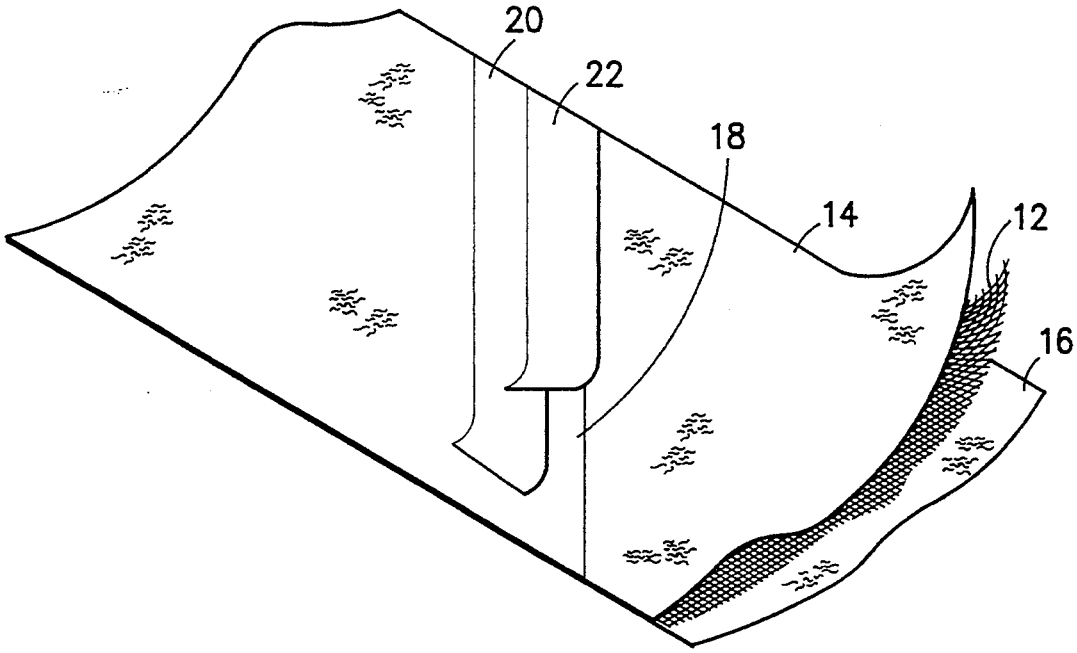
FIG. 3 is a perspective view corresponding to FIG. 1 in which both heat and pressure have been applied to the two layers shown in FIG. 1 including two layers of thermoplastic tape on the upper layer.

Therefore, roofing substrate 10 preferably includes a fiberglas scrim 12 surrounded by an upper nonwoven fabric layer 14 and a lower nonwoven fabric layer 16. Splicing occurs by cutting this roofing substrate 10 and overlapping this material. It is believed the optimal means of achieving the greatest splicing strength is to cut the roofing substrate at a 45° angle and overlapping the roofing substrate 10 by at least six inches. The greater the amount of overlap of roofing substrate 10, the stronger the roofing splice. The diagonal splice overlap is shown in FIG. 3 by numeral 18. The next step in the splicing process is to heat and press a diagonal splice overlap 18 with an iron preheated between 500° F. to 700° F. while applying 1 to 4 p.s.i. of pressure until the upper nonwoven fabric layer 14 and lower nonwoven fabric layer 16 is melted into the fiberglass scrim 12 and the fiberglass scrim 12 is fused together. While the above heat and pressure ranges are preferred, the temperature may range anywhere between 450° F. to 1000° F. and pressure may range anywhere between 0 to 1,000 p.s.i. This therefore shows the essential nature of having openings within the fiberglass scrim, because the upper nonwoven fabric layer 14 and the lower nonwoven fabric layer 16 melt within the holes of the fiberglass scrim therefore creating one completely solidified structure. Heat is applied by means of an iron 30, as shown in FIG. 2. This may take the form of a press in a production-type operation or may even be in the form of a portable hand-held type of unit for easy application.

The next step is to apply at least a strip of thermoplastic tape on each side of the diagonal splice overlap 18 as shown in FIG. 3. The thermoplastic tape should have a heat resistant backing. One illustrative means for achieving heat resistance is to utilize thermoplastic tape with a woven fiberglass backing. The preferred splice would have two strips of fiberglass tape strips on each side of the splice overlap 18. As shown in FIG. 3 there is a first upper thermoplastic tape strip 20 and a second upper thermoplastic tape strip 22. As shown in FIG. 2 there is a first lower thermoplastic tape strip 24 and a second lower thermoplastic strip 26, respectively. It is preferred that these thermoplastic tape strips are at least four inches wide although a wide variety of thermoplastic tape widths will suffice. A thermoplastic adhesive can also be used. Tape of this type is manufactured by Minnesota Mining & Manufacturing Company (3M), 3M Center, St. Paul, Minn. 55144. The fiberglass tape 20, 22, 24 and 26, is again heated with the same iron 30 on both sides until the fiberglass backing on thermoplastic tapes 20, 22, 24 and 26 turns a light brown. This will optimally occur at a temperature of between 500° F. to 700° F. at a pressure of 1 to 4 pounds per square inch. However, the temperature can range between 450° F. to 1,000° F. and the pressure can range between 0 to 1,000 p.s.i. The purpose of the tape is to cover the holes that are created during the first step of the splicing process when the upper nonwoven fabric layer 14 and lower nonwoven fabric layer 16 is melted into the fiberglass scrim 12. Besides adhering the two layers of roofing substrate 10 together, it also prevents holes from appearing in the diagonal splice overlap 18 when the diagonal splice overlap 18 is coated with bitumen when put through an asphalt coater.

As shown in FIG. 3, the roofing substrate 10 is now one continuous solidified structure. With the fiberglass scrim 12 and the upper nonwoven fabric layer 14 and lower nonwoven fabric layer 16 forming one integral unit. The fiberglass backed tape strips 20 and 22 are firmly and fixedly attached to the roofing substrate 10.

The splice described above can be processed in a typical bitumen coater at up to 450° F. at standard speeds and tensions without failing. Physical properties of the splice areas will be equal to or exceed those of the unspliced areas of the same fabric.

For production purposes a heated press can be substituted for the hand-held iron 30 which can operate more precisely at between 500° and 550° F. The area to be spliced would only need to be heated in the press for between fifteen and thirty seconds. This would allow better control of the splicing temperature and time and provide a more consistent production-type of quality. The heating of the fiberglass backed thermoplastic tape 20 and 22 should be at approximately 500° F.

It is not intended that the scope of the invention be limited to the specific embodiment illustrated and described. Rather, it is intended that the scope of the invention be defined by the appendant claims and their equivalents.

What is claimed is:

1. A method of splicing roofing substrate comprising the following steps in the sequence set forth:

(a) applying heat in the range of 450° F. to 1,000° F. and pressure in the range of 0 to 1,000 p.s.i. on a first piece of scrim formed of yarns that do not melt below 500° F. having an upper layer of a first nonwoven piece of fabric formed of fibers that melt below 500° F. which is overlapping a second piece of scrim formed of yarns that do not melt below 500° F. having an upper layer of a second piece of nonwoven fabric formed of fibers that melt below 500° F., thereby forming an overlapping area;

(b) applying at least one layer of heat resistant tape on each side of said overlapping area; and (c) applying heat in the range of 450° F. to 1,000° F. and pressure in the range of 0 to 1,000 p.s.i.

2. A method of splicing roofing substrate comprising the following steps in the sequence set forth:

(a) applying heat in the range of 450° to 700° F. and pressure in the range of 1 to 4 p.s.i. on a first piece of scrim formed of yarns that do not melt below 50° F. having an upper layer of a first nonwoven piece of fabric formed of fibers that melt below 500° F. which is overlapping a second piece of scrim formed of yarns that do not melt below 500° F. having an upper layer of a second piece of nonwoven fabric formed of fibers that melt below 500° F., thereby forming an overlapping area;

(b) applying at least one layer of heat resistant tape on each side of said overlapping area; and (c) applying heat in the range of 500° F. to 700° F. and pressure in the range of 1 to 4 p.s.i.

3. A method of splicing roofing substrate comprising the following steps in the sequence set forth:

(a) applying heat in the range of 450° to 1,000° F. and pressure in the range of 0 to 1,000 p.s.i. on a first piece of scrim formed of fiberglass yarns having an upper layer of a first nonwoven piece of fabric formed of fibers that melt below 500° F. which is overlapping a second piece of scrim formed of fiberglass yarns having an upper layer of a second piece of nonwoven fabric, thereby forming an overlapping area;

(b) applying at least one layer of heat resistant tape on each side of said overlapping area; and (c) applying heat in the range of 450° F. to 1,000° F. and pressure in the range of 0 to 1,000 p.s.i.

4. A method of splicing roofing substrate comprising the following steps in the sequence set forth:

(a) applying heat in the range of 450° to 700° F. and pressure in the range of 1 to 4 p.s.i. on a first piece of scrim formed of fiberglass yarns having an upper layer of a first nonwoven piece of fabric formed of fibers that melt below 500° F. which is overlapping a second piece of scrim formed of fiberglass yarns having an upper layer of a second piece of nonwoven fabric formed of fibers that melt below 500° F., thereby forming an overlapping area;

(b) applying at least one layer of heat resistant tape on each side of said overlapping area; and (c) applying heat in the range of 500° F. to 700° F. and pressure in the range of 1 to 4 p.s.i.

5. A method of splicing roofing substrate comprising the following steps in the sequence set forth:

(a) applying heat in the range of 450° to 1,000° F. and pressure in the range of 0 to 1,000 p.s.i. on a first piece of scrim formed of fiberglass yarns having an upper layer of a first nonwoven polyester piece of fabric which is overlapping a second piece of scrim formed of fiberglass yarns having an upper layer of a second piece of nonwoven polyester fabric thereby forming an overlapping area;

(b) applying at least one layer of heat resistant tape on each side of said overlapping area; and (c) applying heat in the range of 450° F. to 1,000° F. and pressure in the range of 0 to 1,000 p.s.i.

6. A method of splicing roofing substrate comprising the following steps in the sequence set forth:

(a) applying heat in the range of 450° to 700° F. and pressure in the range of 1 to 4 p.s.i. on a first piece of scrim formed of fiberglass yarns that are interposed between an upper layer of first nonwoven polyester fabric and a lower layer of a second nonwoven polyester fabric which is overlapping a second piece of scrim formed of fiberglass yarns having an upper layer of a third piece of nonwoven polyester fabric thereby forming an overlapping area;

(b) applying at least one layer of heat resistant tape on each side of said overlapping area; and (c) applying heat in the range of 500° F. to 700° F. and pressure in the range of 1 to 4 p.s.i.

7. A method of splicing roofing substrate comprising the following steps in the sequence set forth:

(a) applying heat in the range of 450° to 1,000° F. and pressure in the range of 0 to 1,000 p.s.i. on a first piece of scrim formed of yarns that do not melt below 500° F. that are interposed between a first nonwoven piece of fabric and a second nonwoven piece of fabric formed of fibers that melt below 500° F. which is overlapping a second piece of scrim formed of yarns that do not melt below 500° F. interposed between a third piece of nonwoven fabric formed of fibers that melt below 500° F. and a fourth piece of nonwoven fabric formed of fibers that melt below 500° F., thereby forming an overlapping area;

(b) applying at least one layer of heat resistant tape on each side of said overlapping area; and (c) applying heat in the range of 450° F. to 1,000° F. and pressure in the range of 0 to 1,000 p.s.i.

8. A method of splicing roofing substrate comprising the following steps in the sequence set forth:

(a) applying heat in the range of 450° to 700° F. and pressure in the range of 1 to 4 p.s.i. on a first piece of scrim formed of yarns that do not melt below 500° F. that is interposed between a first nonwoven piece of fabric and a second piece of nonwoven fabric formed of fibers that melt below 500° F. which is overlapping a second piece of scrim formed of yarns that do not melt below 500° F. interposed between a third piece of nonwoven fabric formed of fibers that melt below 500° F. and a fourth piece of nonwoven fabric formed of fibers that melt below 500° F., thereby forming an overlapping area;

(b) applying at least one layer of heat resistant tape on each side of said overlapping area; and (c) applying heat in the range of 500° F. to 700° F. and pressure in the range of 1 to 4 p.s.i.

9. A method of splicing roofing substrate comprising the following steps in the sequence set forth:

(a) applying heat in the range of 450° to 1,000° F. and pressure in the range of 0 to 1,000 p.s.i. on a first piece of scrim formed of fiberglass yarns that is interposed between a first nonwoven piece of fabric formed of fibers that melt below 500° F. and a second piece of nonwoven fabric formed of fibers that melt below 500° F. which is overlapping a second piece of scrim formed of fiberglass yarns interposed between a third piece of nonwoven fabric formed of fibers that melt below 500° F. and a fourth piece of nonwoven fabric formed of fibers that melt below 500° F., thereby forming an overlapping area;

(b) applying at least one layer of heat resistant tape on each side of said overlapping area; and (c) applying heat in the range of 450° F. to 1,000° F. and pressure in the range of 0 to 1,000 p.s.i.

10. A method of splicing roofing substrate comprising the following steps in the sequence set forth:

(a) applying heat in the range of 450° to 700° F. and pressure in the range of 1 to 4 p.s.i. on a first piece of scrim formed of fiberglass yarns that is interposed between a first nonwoven piece of fabric formed of fibers that melt below 500° F. and a second piece of nonwoven fabric formed of fibers that melt below 500° F. which is overlapping a second piece of scrim formed of fiberglass yarns interposed between a third piece of nonwoven fabric formed of fibers that melt below 500° F. and a fourth piece of nonwoven fabric formed of fibers that melt below 500° F., thereby forming an overlapping area;

(b) applying at least one layer of heat resistant tape on each side of said overlapping area; and (c) applying heat in the range of 500° F. to 700° F. and pressure in the range of 1 to 4 p.s.i.

11. A method of splicing roofing substrate comprising the following steps in the sequence set forth:

(a) applying heat in the range of 450° to 1,000° F. and pressure in the range of 0 to 1,000 p.s.i. on a first piece of scrim formed of fiberglass yarns that is interposed between a first nonwoven polyester piece of fabric and a second piece of nonwoven polyester fabric which is overlapping a second piece of scrim formed of fiberglass yarns interposed between a third piece of nonwoven polyester fabric and a fourth piece of nonwoven polyester fabric thereby forming an overlapping area;

(b) applying at least one layer of heat resistant tape on each side of said overlapping area; and (c) applying heat in the range of 450° F. to 1,000° F. and pressure in the range of 0 to 1,000 p.s.i.

12. A method of splicing roofing substrate comprising the following steps in the sequence set forth:

(a) applying heat in the range of 450° to 700° F. and pressure in the range of 1 to 4 p.s.i. on a first piece of scrim formed of fiberglass yarns that is interposed between a first nonwoven polyester piece of fabric and a second piece of nonwoven polyester fabric which is overlapping a second piece of fiberglass scrim interposed between a third piece of nonwoven polyester fabric and a fourth piece of nonwoven polyester fabric thereby forming an overlapping area;

(b) applying at least one layer of heat resistant tape on each side of said overlapping area; and (c) applying heat in the range of 500° F. to 700° F. and pressure in the range of 1 to 4 p.s.i.

13. A method of splicing roofing substrate comprising the following steps in the sequence set forth:

(a) applying heat in the range of 450° to 1,000° F. and pressure in the range of 0 to 1,000 p.s.i. on a first piece of scrim formed of yarns that do not melt below 500° F. having upper layers including a plurality of first nonwoven pieces of fabric formed of fibers that melt below 500° F. which is overlapping a second piece of scrim formed of yarns that do not melt below 500° F. having upper layers including a plurality of second nonwoven pieces of fabric formed of fibers that melt below 500° F., thereby forming an overlapping area;

(b) applying at least one layer of heat resistant tape on each side of said overlapping area; and (c) applying heat in the range of 450° F. to 1,000° F. and pressure in the range of 0 to 1,000 p.s.i.

14. A method of splicing roofing substrate comprising the following steps in the sequence set forth:

(a) applying heat in the range of 450° F. to 1,000° F. and pressure in the range of 0 to 1,000 p.s.i. on a first piece of scrim formed of yarns that do not melt below 500° F. having a lower layer of a first nonwoven piece of fabric formed of fibers that melt below 500° F. which is overlapping a second piece of scrim formed of yarns that do not melt below 500° F. having an upper layer of a second piece of nonwoven fabric formed of fibers that melt below 500° F., thereby forming an overlapping area;

(b) applying at least one layer of heat resistant tape on each side of said overlapping area; and (c) applying heat in the range of 450° F. to 1,000° F. and pressure in the range of 0 to 1,000 p.s.i.

15. A method of splicing roofing substrate comprising the following steps in the sequence set forth:

(a) applying heat in the range of 450° F. to 1,000° F. and pressure in the range of 0 to 1,000 p.s.i. on a first piece of scrim formed of yarns that do not melt below 500° F. having an upper layer of a first nonwoven piece of fabric formed of fibers that melt below 500° F. which is overlapping a second piece of scrim formed of yarns that do not melt below 500° F. having a lower layer of a second piece of nonwoven fabric formed of fibers that melt below 500° F., thereby forming an overlapping area;

(b) applying at least one layer of heat resistant tape on each side of said overlapping area; and (c) applying heat in the range of 450° F. to 1,000° F. and pressure in the range of 0 to 1,000 p.s.i.

16. A method of splicing roofing substrate comprising the following steps in the sequence set forth:

(a) applying heat in the range of 450° F. to 1,000° F. and pressure in the range of 0 to 1,000 p.s.i. on a first piece of scrim formed of yarns that do not melt below 500° F. having a lower layer of a first nonwoven piece of fabric formed of fibers that melt below 500° F. which is overlapping a second piece of scrim formed of yarns that do not melt below 500° F. having a lower layer of a second piece of nonwoven fabric formed of fibers that melt below 500° F., thereby forming an overlapping area;

(b) applying at least one layer of heat resistant tape on each side of said overlapping area; and (c) applying heat in the range of 450° F. to 1,000° F. and pressure in the range of 0 to 1,000 p.s.i.

17. A method of splicing roofing substrate comprising the following steps in the sequence set forth:

(a) applying heat in the range of 450° to 700° F. and pressure in the range of 1 to 4 p.s.i. on a first piece of scrim formed of yarns that do not melt below 500° F. having a lower layer of a first nonwoven piece of fabric formed of fibers that melt below 500° F. which is overlapping a second piece of scrim formed of yarns that do not melt below 500° F. having an upper layer of a second piece of nonwoven fabric formed of fibers that melt below 500° F., thereby forming an overlapping area;

(b) applying at least one layer of heat resistant tape on each side of said overlapping area; and (c) applying heat in the range of 500° F. to 700° F. and pressure in the range of 1 to 4 p.s.i.

18. A method of splicing roofing substrate comprising the following steps in the sequence set forth:

(a) applying heat in the range of 450° to 700° F. and pressure in the range of 1 to 4 p.s.i. on a first piece of scrim formed of yarns that do not melt below 500° F. having an upper layer of a first nonwoven piece of fabric formed of fibers that melt below 500° F. which is overlapping a second piece of scrim formed of yarns that do not melt below 500° F. having a lower layer of a second piece of nonwoven fabric formed of fibers that melt below 500° F., thereby forming an overlapping area;

(b) applying at least one layer of heat resistant tape on each side of said overlapping area; and (c) applying heat in the range of 500° F. to 700° F. and pressure in the range of 1 to 4 p.s.i.

19. A method of splicing roofing substrate comprising the following steps in the sequence set forth:

(a) applying heat in the range of 450° to 700° F. and pressure in the range of 1 to 4 p.s.i. on a first piece of scrim formed of yarns that do not melt below 500° F. having a lower layer of a first nonwoven piece of fabric formed of fibers that melt below 500° F. which is overlapping a second piece of scrim formed of yarns that do not melt below 500° F. having a lower layer of a second piece of nonwoven fabric formed of fibers that melt below 500° F., thereby forming an overlapping area;

(b) applying at least one layer of heat resistant tape on each side of said overlapping area; and (c) applying heat in the range of 500° F. to 700° F. and pressure in the range of 1 to 4 p.s.i.

20. A method of splicing roofing substrate comprising the following steps in the sequence set forth:

(a) applying heat in the range of 450° to 1,000° F. and pressure in the range of 0 to 1,000 p.s.i. on a first piece of scrim formed of fiberglass yarns having a lower layer of a first nonwoven piece of fabric formed of fibers that melt below 500° F. which is overlapping a second piece of scrim formed of fiberglass yarns having an upper layer of a second piece of nonwoven fabric, thereby forming an overlapping area;

(b) applying at least one layer of heat resistant tape on each side of said overlapping area; and (c) applying heat in the range of 450° F. to 1,000° F. and pressure in the range of 0 to 1,000 p.s.i.

21. A method of splicing roofing substrate comprising the following steps in the sequence set forth:

(a) applying heat in the range of 450° to 1,000° F. and pressure in the range of 0 to 1,000 p.s.i. on a first piece of scrim formed of fiberglass yarns having an upper layer of a first nonwoven piece of fabric formed of fibers that melt below 500° F. which is overlapping a second piece of scrim formed of fiberglass yarns having a lower layer of a second piece of nonwoven fabric, thereby forming an overlapping area;

(b) applying at least one layer of heat resistant tape on each side of said overlapping area; and (c) applying heat in the range of 450° F. to 1,000° F. and pressure in the range of 0 to 1,000 p.s.i.

22. A method of splicing roofing substrate comprising the following steps in the sequence set forth:

(a) applying heat in the range of 450° to 1,000° F. and pressure in the range of 0 to 1,000 p.s.i. on a first piece of scrim formed of fiberglass yarns having a lower layer of a first nonwoven piece of fabric formed of fibers that melt below 500° F. which is overlapping a second piece of scrim formed of fiberglass yarns having a lower layer of a second piece of nonwoven fabric, thereby forming an overlapping area;

(b) applying at least one layer of heat resistant tape on each side of said overlapping area; and (c) applying heat in the range of 450° F. to 1,000° F. and pressure in the range of 0 to 1,000 p.s.i.

23. A method of splicing roofing substrate comprising the following steps in the sequence set forth:

(a) applying heat in the range of 450° to 700° F. and pressure in the range of 1 to 4 p.s.i. on a first piece of scrim formed of fiberglass yarns having a lower layer of a first nonwoven piece of fabric formed of fibers that melt below 500° F. which is overlapping a second piece of scrim formed of fiberglass yarns having an upper layer of a second piece of nonwoven fabric formed of fibers that melt below 500° F., thereby forming an overlapping area;

(b) applying at least one layer of heat resistant tape on each side of said overlapping area; and (c) applying heat in the range of 500° F. to 700° F. and pressure in the range of 1 to 4 p.s.i.

24. A method of splicing roofing substrate comprising the following steps in the sequence set forth:

(a) applying heat in the range of 450° to 700° F. and pressure in the range of 1 to 4 p.s.i. on a first piece of scrim formed of fiberglass yarns having an upper layer of a first nonwoven piece of fabric formed of fibers that melt below 500° F. which is overlapping a second piece of scrim formed of fiberglass yarns having a lower layer of a second piece of nonwoven fabric formed of fibers that melt below 500° F., thereby forming an overlapping area;

(b) applying at least one layer of heat resistant tape on each side of said overlapping area; and (c) applying heat in the range of 500° F. to 700° F. and pressure in the range of 1 to 4 p.s.i.

25. A method of splicing roofing substrate comprising the following steps in the sequence set forth:

(a) applying heat in the range of 450° to 700° F. and pressure in the range of 1 to 4 p.s.i. on a first piece of scrim formed of fiberglass yarns having a lower layer of a first nonwoven piece of fabric formed of fibers that melt below 500° F. which is overlapping a second piece of scrim formed of fiberglass yarns having a lower layer of a second piece of nonwoven fabric formed of fibers that melt below 500° F., thereby forming an overlapping area;

(b) applying at least one layer of heat resistant tape on each side of said overlapping area; and (c) applying heat in the range of 500° F. to 700° F. and pressure in the range of 1 to 4 p.s.i.

26. A method of splicing roofing substrate comprising the following steps in the sequence set forth:

(a) applying heat in the range of 450° to 1,000° F. and pressure in the range of 0 to 1,000 p.s.i. on a first piece of scrim formed of fiberglass yarns having a lower layer of a first nonwoven polyester piece of fabric which is overlapping a second piece of scrim formed of fiberglass yarns having an upper layer of a second piece of nonwoven polyester fabric thereby forming an overlapping area;

(b) applying at least one layer of heat resistant tape on each side of said overlapping area; and (c) applying heat in the range of 450° F. to 1,000° F. and pressure in the range of 0 to 1,000 p.s.i.

27. A method of splicing roofing substrate comprising the following steps in the sequence set forth:

(a) applying heat in the range of 450° to 1,000° F. and pressure in the range of 0 to 1,000 p.s.i. on a first piece of scrim formed of fiberglass yarns having an upper layer of a first nonwoven polyester piece of fabric which is overlapping a second piece of scrim formed of fiberglass yarns having a lower layer of a second piece of nonwoven polyester fabric thereby forming an overlapping area;

(b) applying at least one layer of heat resistant tape on each side of said overlapping area; and (c) applying heat in the range of 450° F. to 1,000° F. and pressure in the range of 0 to 1,000 p.s.i.

28. A method of splicing roofing substrate comprising the following steps in the sequence set forth:

(a) applying heat in the range of 450° to 1,000° F. and pressure in the range of 0 to 1,000 p.s.i. on a first piece of scrim formed of fiberglass yarns having a lower layer of a first nonwoven polyester piece of fabric which is overlapping a second piece of scrim formed of fiberglass yarns having a lower layer of a second piece of nonwoven polyester fabric thereby forming an overlapping area;

(b) applying at least one layer of heat resistant tape on each side of said overlapping area; and (c) applying heat in the range of 450° F. to 1,000° F. and pressure in the range of 0 to 1,000 p.s.i.

29. A method of splicing roofing substrate comprising the following steps in the sequence set forth:

(a) applying heat in the range of 450° to 700° F. and pressure in the range of 1 to 4 p.s.i. on a first piece of scrim formed of fiberglass yarns that are interposed between an upper layer of first nonwoven polyester fabric and a lower layer of a second nonwoven polyester fabric which is overlapping a second piece of scrim formed of fiberglass yarns having a lower layer of a third piece of nonwoven polyester fabric thereby forming an overlapping area;

(b) applying at least one layer of heat resistant tape on each side of said overlapping area; and (c) applying heat in the range of 500° F. to 700° F. and pressure in the range of 1 to 4 p.s.i.

30. A method of splicing roofing substrate comprising the following steps in the sequence set forth:

(a) applying heat in the range of 450° to 1,000° F. and pressure in the range of 0 to 1,000 p.s.i. on a first piece of scrim formed of yarns that do not melt below 500° F. having lower layers including a plurality of first nonwoven pieces of fabric formed of fibers that melt below 500° F. which is overlapping a second piece of scrim formed of yarns that do not melt below 500° F. having upper layers including a plurality of second nonwoven pieces of fabric formed of fibers that melt below 500° F., thereby forming an overlapping area;

(b) applying at least one layer of heat resistant tape on each side of said overlapping area; and (c) applying heat in the range of 450° F. to 1,000° F. and pressure in the range of 0 to 1,000 p.s.i.

31. A method of splicing roofing substrate comprising the following steps in the sequence set forth:

(a) applying heat in the range of 450° to 1,000° F. and pressure in the range of 0 to 1,000 p.s.i. on a first piece of scrim formed of yarns that do not melt below 500° F. having upper layers including a plurality of first nonwoven pieces of fabric formed of fibers that melt below 500° F. which is overlapping a second piece of scrim formed of yarns that do not melt below 500° F. having lower layers including a plurality of second nonwoven pieces of fabric formed of fibers that melt below 500° F., thereby forming an overlapping area;

(b) applying at least one layer of heat resistant tape on each side of said overlapping area; and (c) applying heat in the range of 450° F. to 1,000° F. and pressure in the range of 0 to 1,000 p.s.i.

32. A method of splicing roofing substrate comprising the following steps in the sequence set forth:

(a) applying heat in the range of 450° to 1,000° F. and pressure in the range of 0 to 1,000 p.s.i. on a first piece of scrim formed of yarns that do not melt below 500° F. having lower layers including a plurality of first nonwoven pieces of fabric formed of fibers that melt below 500° F. which is overlapping a second piece of scrim formed of yarns that do not melt below 500° F. having lower layers including a plurality of second nonwoven pieces of fabric formed of fibers that melt below 500° F., thereby forming an overlapping area;

(b) applying at least one layer of heat resistant tape on each side of said overlapping area; and (c) applying heat in the range of 450° F. to 1,000° F. and pressure in the range of 0 to 1,000 p.s.i.

* * * * *